US005092397A

United States Patent [19]

Fuhrmann et al.

[11] Patent Number: 5,092,397

[45] Date of Patent: Mar. 3, 1992

[54] FIN FOR A HEAT EXCHANGER AND HEAT EXCHANGING SYSTEM USING THE FIN

[75] Inventors: Ernst Fuhrmann, Espenau; Richard Scholze, Hofgeismar, both of Fed. Rep. of Germany

[73] Assignee: Autokühler GmbH & Co KG, Hofgeismar, Fed. Rep. of Germany

[21] Appl. No.: 502,546

[22] Filed: Mar. 30, 1990

[30] Foreign Application Priority Data

Mar. 30, 1989 [DE] Fed. Rep. of Germany ..... 3910357

[51] Int. Cl.[5] ..... F28F 1/32

[52] U.S. Cl. ..... 165/151; 165/182

[58] Field of Search ..... 165/151, 182

[56] References Cited

U.S. PATENT DOCUMENTS 3,771,595 9/1971 Slaasted ..... 165/151
3,829,647 8/1974 Cleaveland ..... 200/289

FOREIGN PATENT DOCUMENTS 1067045 10/1959 Fed. Rep. of Germany ..... 165/182
3423746 1/1986 Fed. Rep. of Germany .
708355 7/1931 France ..... 165/151
1445981 6/1966 France .
2465984 3/1981 France .
360280 11/1931 United Kingdom .
471553 9/1937 United Kingdom .
576864 4/1946 United Kingdom ..... 165/151

OTHER PUBLICATIONS 0 176 729, European Patent Application, Dirk Pietzcker 8/1985.

*Primary Examiner*—Allen J. Flanigan
*Attorney, Agent, or Firm*—Michael J. Striker

[57] ABSTRACT

A heat conducting fin for a heat exchanger is provided with an array of deep drawn collars defining passages with flattened, oval cross-sections for receiving heat exchanging pipes of a corresponding cross-section. In order to prevent the formation of cracks in the collars particularly when a large ratio of the maximum diameter to the minimum diameter of the oval collar involves very small radii of curvatures, the height of the collar in the region of its small radius of curvature is less than in the region of its large radius of curvature. The invention also relates to a heat exchanger including a stack of such fins and a series of heat exchanging pipes passing through the passages in the collars and being attached to the inner walls of the collars by expanding corresponding pipe portions.

2 Claims, 5 Drawing Sheets

Fig.2.
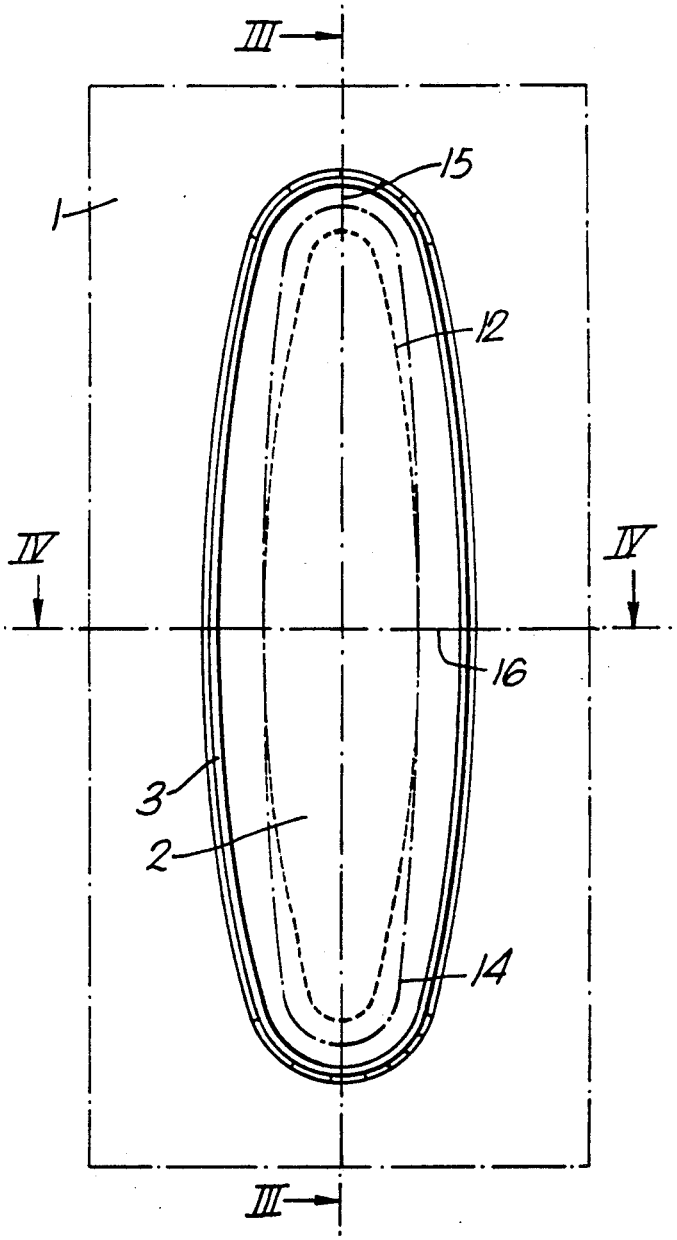
Fig.3.
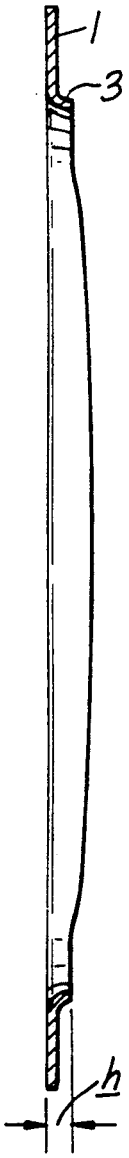
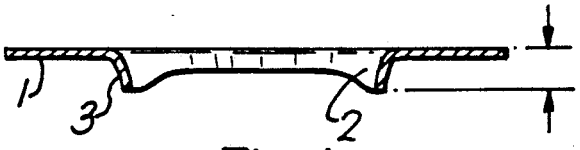
Fig.4.

Fig.5.
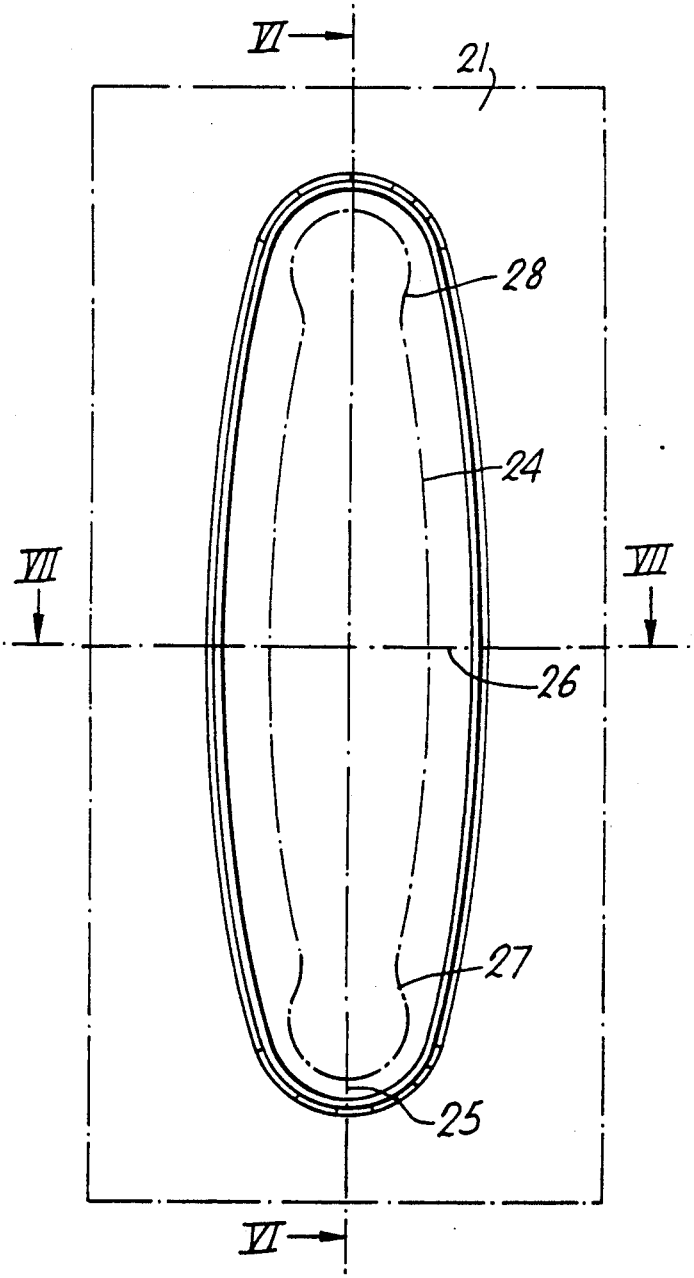
Fig.6.
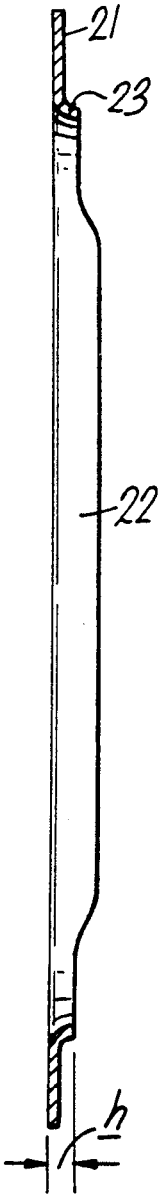
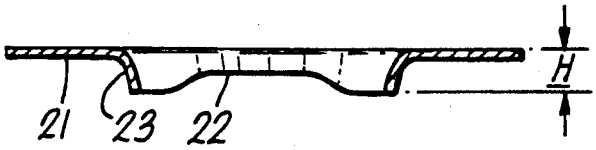
Fig.7.

Fig.8.
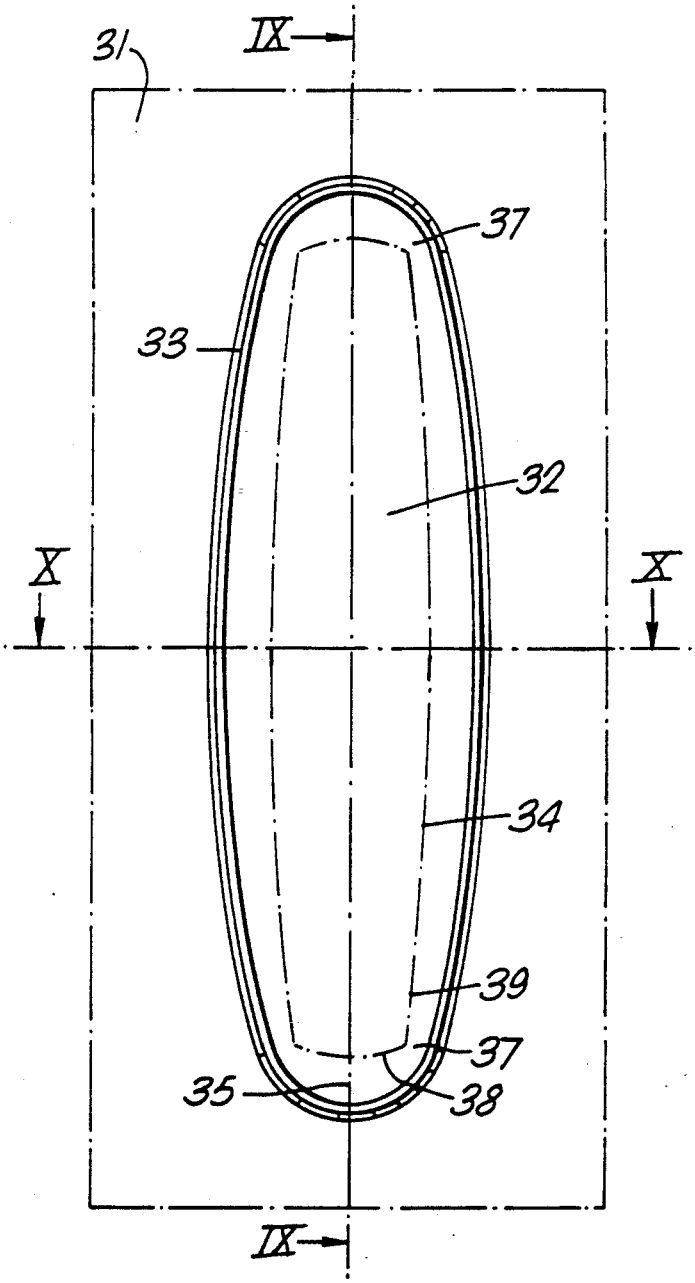
Fig.9.
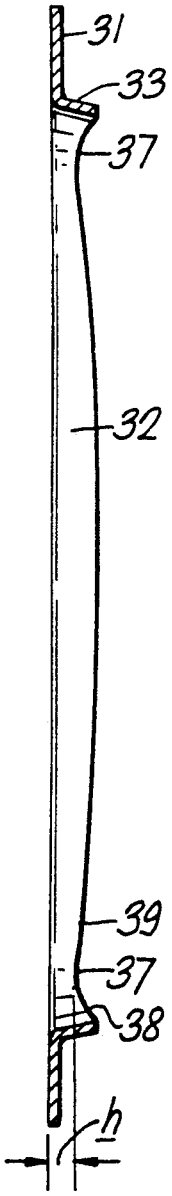
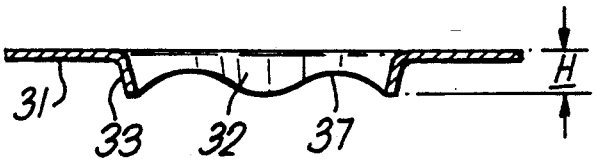
Fig.10.

Fig.11.
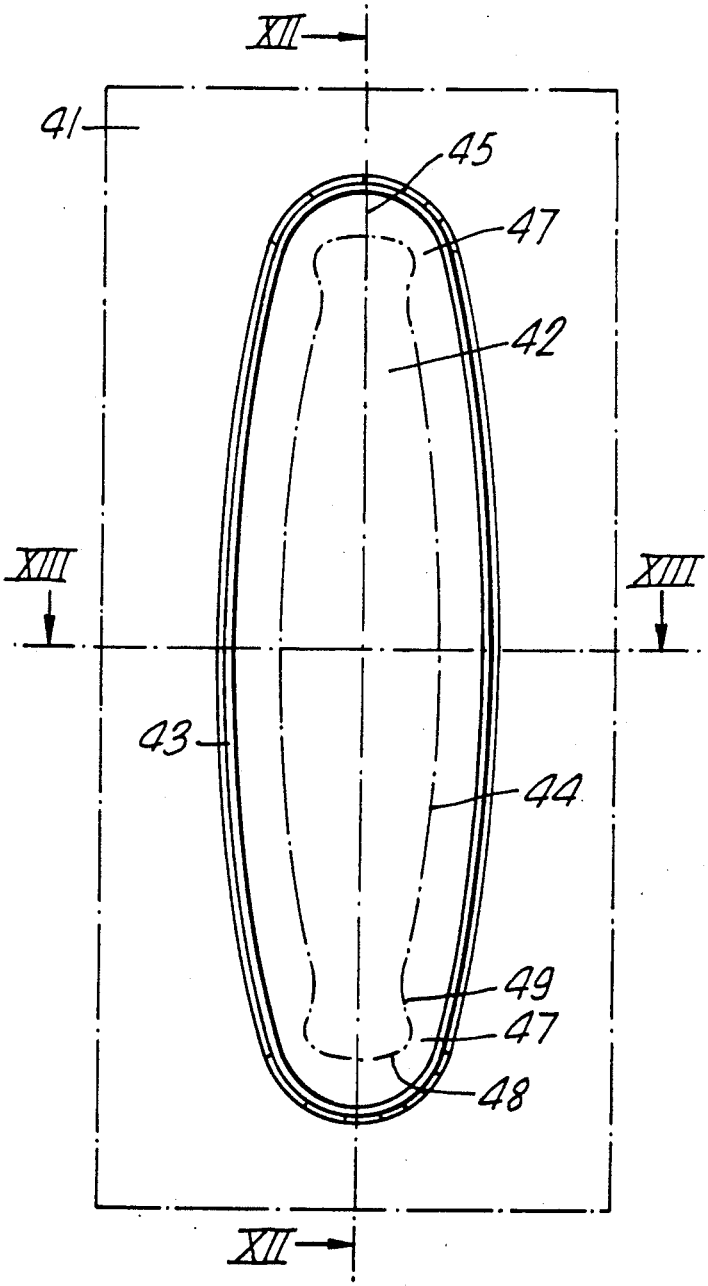
Fig.12.
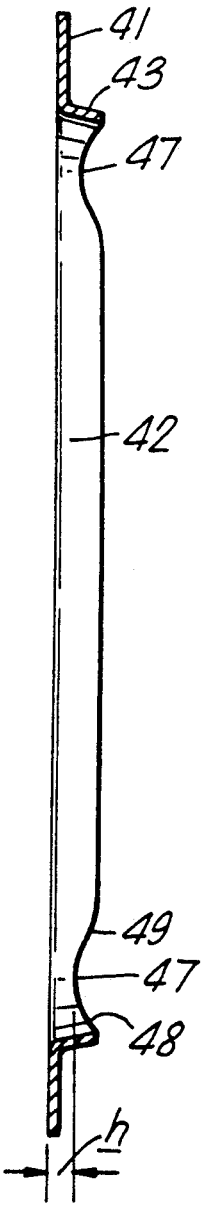
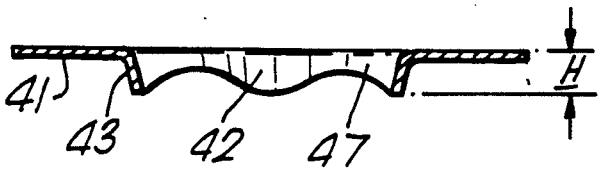
Fig.13.

FIN FOR A HEAT EXCHANGER AND HEAT EXCHANGING SYSTEM USING THE FIN

BACKGROUND OF THE INVENTION

The present invention relates to a sheet metal fin for use in a heat exchanger, and also relates to a heat exchanging system having such sheet metal fins.

Fins in the form of metal sheets provided with oval passages for receiving oval heat exchanging pipes are generally known in heat exchangers, particularly in radiators for motor vehicles (EP 0176 729). Each of the passages in the fin includes a drawn through collar whose height is constant over the entire periphery of the passage or at most fluctuates within standard tolerance range. An optimum height of the collars is usually determined experimentally because by increasing the height of the collars above a certain level no substantial increase in efficiency of the heat exchanger is achieved whereas collar heights below the optimum height leads to a distinct lowering of efficiency. The drawn down collars are manufactured in such a way that in a first punching step a plurality of openings is punched out in the sheet metal fin by means of draw punch and a die having cutting edges; subsequently in a second deep drawing step the oval collar is shaped by means of a drawing punch and a further drawing die.

Heat exchanger provided with fins of the above described kind represent a special type of pipe radiators. They distinguish from conventional pipe radiators primarily due to the fact that the heat exchanging pipes are connected to the sheet metal fins solely by expansion of their cross-section without any additional soldering, welding or glueing of the pipes to the edges of the corresponding passages. In order to achieve a good thermal efficiency it is necessary that the walls of the pipes always fully contact the inner wall of the collars.

When using pipes of oval cross-section whose ratio of the maximum diameter to the minimum diameter is relatively small, for example 2:1, there are no problems in accomplishing a perfect connection. However in the case of extremely flat oval cross-sections of the pipes wherein the ratio of the two diameters is larger for example 3:1 through 8:1, it is necessary to provide increased heights of the collars. Due to the dimensions of the collars, the increased height during the deep drawing step leads to an expansion of the sheet metal material by 200% and more which reach and frequently exceed the tensile strength of the collars. As a consequence, in order to reliably prevent the crack formation during the drawing of the collars, the height of the collars is less than the optimum value. This in turn causes an undesirable reduction of efficiency. Alternatively, attempts must be made to prevent the formation of cracks in the processed collars by using a special quality of the sheet metal material. This possibility, however, would increase material costs on the one hand, and would not insure with certainty that during subsequent expansion of the pipes or even during the following use of the heat exchanger, the collars would not crack due to mechanical vibrations, hydraulic pressure of the cooling fluid, thermal expansions, coupling contraction and the like, on the other hand. Since cracks in the collars diminish not only the efficiency of the heat exchanger but also substantially reduce the circumferential tension in the collar necessary for establishing a proper contact with the heat exchanging pipe, the mass production of sheet metal fins for extremely flattened oval heat exchanging pipes and thus of the final heat exchangers still represents an excessive safety risk as long as, for achieving a high efficiency of the heat exchanger, the optimum height of the collar is to be achieved.

SUMMARY OF THE INVENTION

It is therefore an object of this invention to provide heat exchanging fins and a heat exchanger equipped with such fins of the above described kind wherein the cracking of the collars in the fins is substantially avoided without the payoff a lower efficiency of the heat exchanger.

In keeping with this object and others which will become apparent hereafter, one feature of this invention resides in providing the fin with passages delimited by a drawn through collar of an oval cross-section for engaging a heat exchanging oval pipe, the collar having a height which in regions of small radii of curvature of the collar is less than the height in regions of large radii of the curvature. The heat exchanger of this invention includes a stack of such sheet metal fins in contact with a plurality of heat exchanging oval pipes passing through the oval passages in the drawn down collars and being brought in contact with the inner wall of the collars by expanding corresponding pipe portions, and the height of each collar in its region of small radii of curvature being less than in the regions of large radii of curvature.

The invention brings about the surprising advantage that it makes possible a useful compromise between the mechanical and thermal effects of the collars because the novel reduction of height of the collar in the regions of smaller radii of curvature almost completely eliminates the tendency to the crack formation on the one hand, but causes only a negligible reduction in efficiency of the overall heat transfer on the other hand.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a plan view of a drawn down collar in the sheet metal fin for the heat exchanger of FIG. 1, shown on an enlarged scale;

FIGS. 3 and 4 show sectional side views of the collar of FIG. 2 taken along the lines III—III and IV—IV, respectively; and FIGS. 5 through 7, FIGS. 8 through 10 and FIGS. 11 through 13 show further embodiments of the heat exchanging fin of this invention.

DESCRIPTION OF THE PREFERRED EMBODIMENTS

Figure 1:
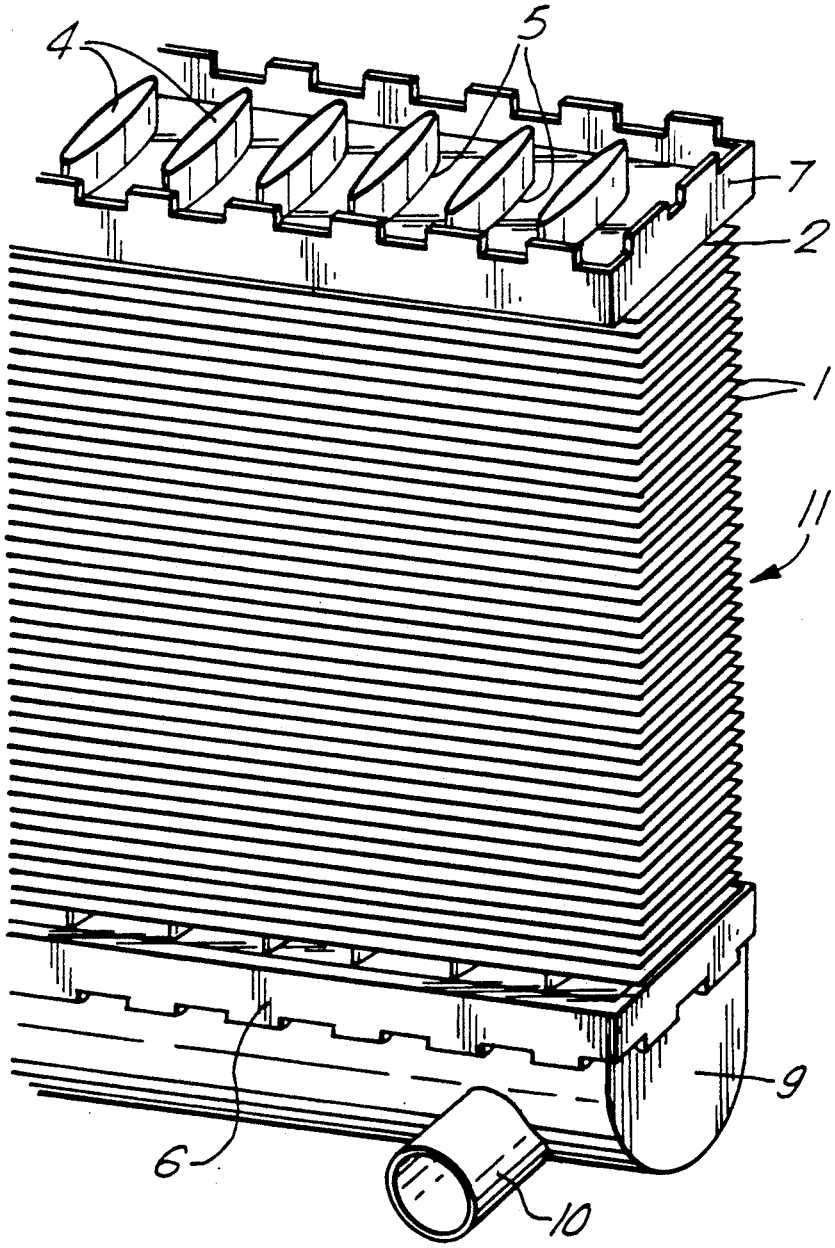
FIG. 1 is a perspective view of a heat exchanger having a network of finned heat exchanging pipes of a flattened oval cross-section.

The heat exchanger illustrated in FIG. 1 is a conventional type radiator. It includes a plurality of parallel, sheet metal fins 1 stacked at a distance one above the other and each having a series of flattened oval openings or passages 2 which are in vertical alignment. The passages 2 illustrated in FIGS. 2 through 4, are delimited by collars 3 drawn through the sheet metal material of the fins 1 to engage the pipes which pass through the passages 2 at right angles to the fins 1. As mentioned before, the pipe 4 have a cross-section corresponding to the oval cross-section of passages 2. The upper and lower end portions of the pipes 4 project also through corresponding oval passages 5 in end plates 6 and 7. The end plates are provided with similar drawn through collars and with sealing means which connect the entire periphery of the collars in the passages 5 with the end portions of the pipes in a liquid tight or gas tight manner. To the bottom end plate 6 a conventional liquid collecting vessel 9 is attached. The vessel has a connecting piece 10 for feeding in or out the cooling medium such as water flowing through the pipes 4. A corresponding, non-illustrated cooling liquid collecting vessel is also connected with the top end plate 7. The sheet metal fins 1 can be also provided with conventional, non-illustrated arrays of gilles and the like which serve for whirling a second cooling medium, such as air. The stack or array 11 of heat conducting fins 1 and pipes 4 is generally called a heat exchanging network.

FIGS. 2 through 4 show by way of an example a single passage 2 in a portion of the fin 1. All remaining passages 2 in respective fins 1 are constructed identically and therefore for the sake of simplicity are not illustrated in the drawing. The illustrated passage 2 has a longest diameter of about 12.2 mm, a shorter diameter of about 3.4 mm and consequently the ratio of the longest diameter to the shortest diameter is about 3.6 mm. For a sheet metal fin 1 provided with passages 2 of the above dimension an optimum height H (FIG. 4) of 0.6 mm is required. According to the contemporary technology at least the collars 3 are manufactured in such a way that in a preliminary step an initial opening 12 indicated by dotted lines in FIG. 2, is punched out in the sheet metal fin 1. The initial opening 12 has a smallest diameter d1, the largest diameter D1, the smallest radius of curvature r1 and the largest radius of curvature R1. If in the completed passage 2 the corresponding measured values are indicated by reference characters d2, D2, r2 and R2, then the following equations are approximately valid: $d1=d2-2h$; $D1=D2-2H$; $r1=r2-h$; and $R1=R2-H$, wherein h is the minimum height of the collar 3 and H is the maximum height of the collar. If r2 is for example 1.1 mm, then according to the above equation, $r1=1.1\ mm-0.6\ mm=0.5\ mm$. Consequently, for drawing of the collar 3, a material expansion of more than 200% would be necessary.

By contrast, in accordance with this invention a flat oval opening is first punched out in the sheet metal fin 1, whose contour is indicated by the dash and dot line 14 in FIG. 2. The shape of the line 14 also represents the outer contour of the employed cutting punch. In contrast to the prior art punched out contour 12 whose clearance from the desired contour of the collar 3 is constant throughout its entire periphery, the clearance of the line 14 from the desired contour of the collar 3 is smallest in the range of the smallest radius of curvature of the collar 3, that means at the point 15 whereas in the range of the largest radius of curvature, that means at the point 16, the clearance is maximal. Therefore if in the following deep drawing step a drawing punch is employed whose outer contour corresponds to the desired inner contour of the collar 3 then automatically a drawn through collar 3 results which at the point 16 of the largest radius of curvature has a maximum height H (FIG. 4), whereas in the range of the smallest radius of curvature, that means at the point 15 has a minimum height h (FIG. 3). Between the points 15 and 16 the height gradually increases to the maximum value H. Depending on individual applications, the transition regions of the height may have more or less abrupt change in steepness of its course. In particular, it is possible that the smaller height h increases to the maximum value H at a faster rate than in the embodiment of FIG. 2 in order to provide the optimum size H over a largest possible peripheral portion of the collar 3 so that the efficiency of a heat exchanger equipped with fins 1 of this embodiment be maximum.

The latter variation is illustrated in FIGS. 5 to 7. The sheet metal fin 21 corresponds to that in the embodiment of FIGS. 2 to 4 and defines a drawn through collar 23 delimiting a flattened, oval passage 22. The dash and dot line 24 denotes the outer contour of the cutting punch of a punching tool or the contour of the opening punched out in the metal sheet 21 by this tool. At the points 25, 26 corresponding to locations 15 and 16 of the preceding example, the collar 23 has again a height $h=0.3$ mm or $H=0.6$ mm. In contrast to the embodiment of FIGS. 2 to 4, the height of the collar 23 changes only along relatively short transition regions 27 and 28 to increase to its full value H.

The advantages obtained by means of this invention as far as a more favorable material expansion during the deep drawing of the collars 3 or 23 is concerned, can be explained by peripheral changes of metal sheet material sections participating in the formation of the collar. In the case of conventional technology the smallest radius r1 after the completion of the first or preliminary steps (line 12 in FIG. 2) amounts to about 0.5 mm and the smallest radius r2 after the drawing through of the collar 3 amounts to about 1.1 mm. For a semi-circular periphery these dimensions produce during the transition from r1 to r2 a peripheral change of 1.9 mm corresponding to an expansion of about 220%. With a reduce height of the collar in the range of the smallest radius of curvature ($r1=0.8$ mm, $r2=1.1$ mm) the corresponding peripheral change amounts only to about 0.9 mm corresponding to an expansion of 138%.

A particular advantage of this invention is in the fact that the dimension h can be selected such as to be optimally suited to particular manufacturing and technological conditions in order to preclude the crack formation in the drawn collar 3; the dimension H can be selected such as it is desirable in view of an optimum heat exchange. The intermediate transition regions also can be optimized with respect to the beforementioned two requirements.

A further advantage resulting from the different dimensions h and H is to be seen in that the outer contour of the cutting punch used for punching the initial opening indicated in FIG. 2 is larger in cross-section than that used in prior art technology. This feature is particularly advantageous for the service life and reproducibility of the cutting punch. In this exemplary embodiment ($d2=3.4$ mm, $D2=12.2$ mm) a height value h of 0.3 mm and a height value H of 0.6 mm has been found to be best for the contour of the collar of FIGS. 2 through 4.

In the embodiment according to FIGS. 8 through 10, a sheet metal fin 31 is provided with an oval passage 32 delimited by a drawn through collar 33. The dash and dot line 34 indicates outer contour of the cutting punch and the inner contour of the initial opening stamped by the cutting punch after the first or preliminary step. The points 35 and 36 correspond to the points 15 and 16 in the first embodiment; the collar 33, in contrast to FIGS. 2 through 7, has its maximum height H amounting for example to 0.6 mm. The smallest height h is for example 0.3 mm and is present always at a point 37 located at a region where the smallest radius of curvature has just joined the large radius of curvature. Between this point 37 of the smallest height h and the points 35 or 36 are again provided transition regions 38 or 39 along which the height gradually increases or decreases to the corresponding end values. The height values at the points 35 and 36 can be the same but also may differ one from the other. The points 37 are preferably arranged at those locations where the collar 33 during the particular drawing through conditions is most strongly susceptible to the crack formation.

FIGS. 11 through 13 show a modification of the embodiment of FIGS. 8 through 10. It includes a fin 41 having a passage 42 delimited by a collar 43 whereby the initial opening produced by the preliminary stamping out step extends along the dash and dot line 44. The difference with respect to FIGS. 8 through 10 are the transition regions 47 between the points 48 and 49 where the collar 43 has its minimum height h and the regions 45 and 46 where the minimum height abruptly changes to the maximum height H (FIG. 13), similarly as in the transition regions 27, 28 of the embodiment according to FIGS. 5 through 7 in comparison to the embodiment of FIGS. 2 to 4.

Considering the fact that at the flow intake side of a heat exchanging pipe 4 (FIG. 1) the heat is directly conductive to air whereas at the flow outlet side of the pipe this effect does not take place, the height of the collars in the fins at the flow intake side can have a contour corresponding to FIGS. 2 through 7 whereas at the flow outlet side according to FIGS. 8 through 13.

It will be understood that this invention is not limited to the details shown in the above embodiments but can be modified in many ways without departing from the spirit of this invention. In particular the dimensions h and H and the contour of the transition regions between these values of the collar height corresponding to lines 14, 24, 34 or 44 in FIGS. 2, 5, 8 and 11 can be advantageously modified in accordance with the requirements of particular applications. In addition, this invention can be also applied to heat conducting fins and heat exchanging networks which contain more than one row of heat exchanging pipes 4 as shown in FIG. 1. In all embodiments the value of the minimum height of the collar can be equal to zero.

Furthermore, the invention is not limited to oval configurations of the pipes in strictly mathematical sense. Under the term "oval" for the purposes of this invention are to be understood all configurations of the passages, collars and pipes which generally resemble an oval, elliptical, egg-shaped and the like curved contours generally described as "flattened oval" configurations. They may include two parallel, straight opposite sides whose ends are connected by arcuate, elliptic, semi-circular and the like curved sides. Also the pipes having such cross-sectional configuration should have a ratio of the maximum diameter to the minimum diameter of 2.5:1 through 8:1.

What is claimed as new and desired to be protected by Letters Patent is set forth in the appended claims.

1. A fin for a heat exchanger, comprising a metal sheet provided with a plurality of drawn through oval collars each delimiting a passage for receiving an oval heat exchanging pipe, said collars having a height which in regions of small radii of curvature of the collar is less than in regions of large radii of curvature, and the height of the collar in the location of the minimum radius of curvature has a larger value than in adjoining locations in said regions of small radii of curvature.

2. A heat exchanger system comprising a plurality of fins spaced from each other and having a plurality of passages therein with an inner oval cross-section; and a plurality of heat exchanging tubes having a corresponding cross-section, extending through said passages and connected to said fins by radial expansion; each of said plurality of fins comprising a metal sheet having a plurality of passages for receiving said heat exchanging tubes, and a plurality of collars having openings defining said passages, said openings having a predetermined inner oval contours having larger and smaller radii of curvature and maximum and minimum diameters, and said collars having a height which in regions of the larger radii of curvature and smaller in regions of the smaller radii of curvature is less than in regions of the larger radii or curvature, wherein the height of said collars in the location of a minimum radius of curvature of said openings has a larger value than in adjoining locations in said regions of the smaller radii of curvature.

* * * * *